United States Patent [19]

Alley

[11] Patent Number: 4,936,381

[45] Date of Patent: Jun. 26, 1990

[54] BAFFLE FOR TUBULAR HEADER

[75] Inventor: Scot T. Alley, Racine, Wis.

[73] Assignee: Modine Manufacturing Company, Racine, Wis.

[21] Appl. No.: 289,698

[22] Filed: Dec. 27, 1988

[51] Int. Cl.[5] ..... F28D 1/02

[52] U.S. Cl. ..... 165/176; 138/94.3

[58] Field of Search ..... 165/174, 176; 138/94.3

[56] References Cited

U.S. PATENT DOCUMENTS 1,078,271 11/1913 Force ..... 138/94.3
3,860,038 1/1975 Forni ..... 138/94.3
4,615,385 10/1986 Saperstein ..... 165/175
4,825,941 5/1989 Hoshino ..... 165/176 X

*Primary Examiner*—Robert G. Nilson
*Attorney, Agent, or Firm*—Wood, Dalton, Phillips Mason & Rowe

[57] ABSTRACT

The heat exchanger having a pair of elongated, tubular headers 10, 12 with tubes 14 extending between the headers 10, 12 and in fluid communication with the interiors thereof. Opposed slots 32, 34; 34, 52; 34, 56, 58; extend generally transverse to the length of the tubular headers 10, 12 and a baffle piece 26, 26', 26'', 26''' and 26'''' located in such slots.

14 Claims, 1 Drawing Sheet

FIG. 1
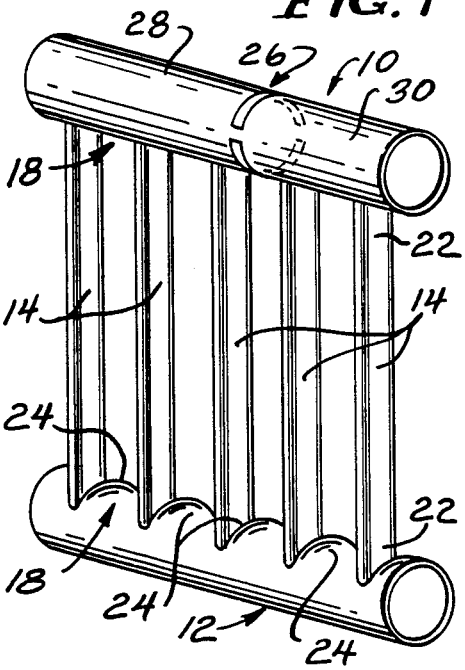
FIG. 2
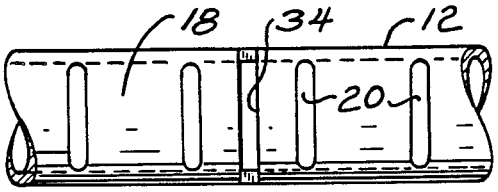
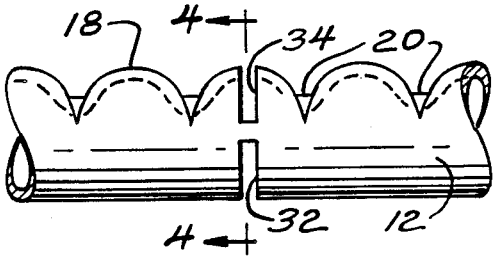
FIG. 3
FIG. 4
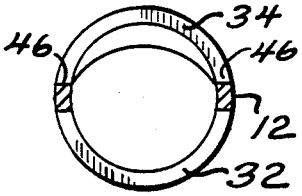
FIG. 5
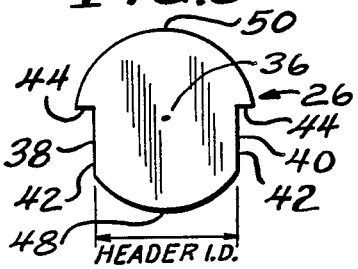
FIG. 6
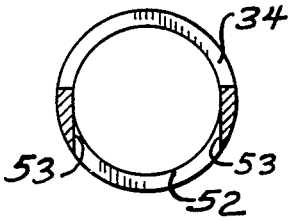
FIG. 7
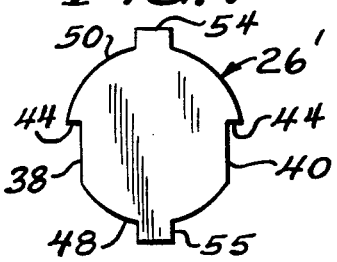
FIG. 8
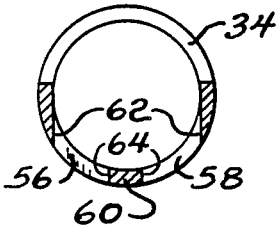
FIG. 9
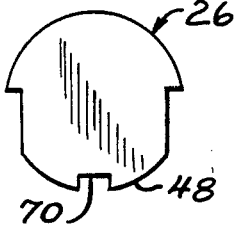
FIG. 10
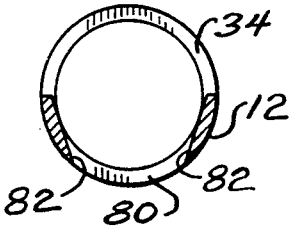
FIG. 11
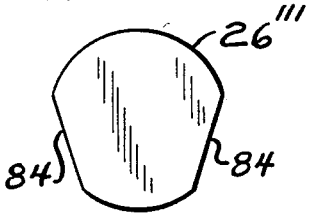
FIG. 12
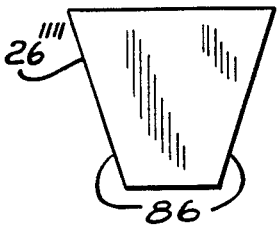

BAFFLE FOR TUBULAR HEADER

FIELD OF THE INVENTION

This invention relates to heat exchangers of the type having at least one tubular header, and more specifically, to a new and improved baffle construction for use in such a heat exchanger.

BACKGROUND OF THE INVENTION

Many types of heat exchangers in use today employ two spaced header and tank constructions. Generally parallel, open ended tubes interconnect the header and tank constructions and are in fluid communication with the interior of each. In many cases, plate or serpentine fins are disposed across the tubes between the header and tank constructions. Typical examples of such heat exchangers are vehicular radiators, condensers, evaporators and the like although such heat exchangers may be found in many other applications as well.

In many of the applications, particularly applications such as that of a condenser, substantial pressures may be present on the interior of the heat exchanger. In order to withstand such pressures, there has been an increasing use of tubular header and tank constructions, that is, the use of a tube to serve both the function of a header and a tank. Usually, such tubular headers are cylindrical, having a generally circular cross section. An example may be found in commonly assigned U.S. Pat. No. 4,615,385.

As shown in that patent, the tubes extending between the two headers are in hydraulic parallel and that in turn means that the fluid on the interior of the heat exchanger makes but a single pass through the heat exchanger. In a number of instances, it may be desirable that the fluid within the heat exchanger make two or more passes across the heat exchanger. That may be accomplished by placing one or more baffles in the tubular headers, the number and and location of such baffles being dependent upon the number of passes desired as well as the specific application to which the heat exchanger is to be put.

Various baffles constructions have been proposed. In one, a simple circular slug or disc is placed in the tubular header and brazed or soldered in place.

In another construction, two slightly offset slots are formed on opposite sides of the header and semi-circular discs are introduced into the slots and have their sides in abutment within the header. They too, are then soldered or brazed in place.

Still another type of baffle is illustrated in Japanese patent publication No. Sho63-49193, published Apr. 2, 1988. In this construction, the tubular header is slotted along a diameter and a baffle having a large radius and a small radius is employed. The large radius is equal to the outer diameter of the tubular header while the small radius is equal to inner diameter of the header and both extend for 180° about the baffle. The small radius is introduced into the header through the slot and the baffle is then brazed or soldered in place.

While such constructions do perform the function of baffles as generally desired, they are not completely foolproof. For one, the contact area between the header and the baffle is not as great as might be desired with the consequence that the braze potential is not as great as may be desired. The lesser braze potential means that leaks are more prone to form.

Furthermore, if a leakage path across the baffle exists, and such leakage path is not across a slot in the header, detection of leakage is difficult.

In addition, in a number of cases mentioned previously, the baffle must be inserted before the tubular header is made part of a heat exchanger core, thus placing a constraint on manufacturing flexibility.

The present invention is directed to overcoming one or more of the above problems.

SUMMARY OF THE INVENTION

It is the principal object of the invention to provide a new and improved heat exchanger of the type employing at least one tubular header with a baffle therein.

An exemplary embodiment of the invention is directed to a heat exchanger having a pair of elongated, spaced headers with tubes extending between the headers and in fluid communication with the interiors thereof. At least one of the headers is tubular and has a slot on one side that is generally transverse to the length of the tubular header. A baffle piece is disposed in the slot to prevent full flow of a heat exchange fluid through the tubular header at the location of the baffle.

According to the invention, there is the improvement which comprises an additional slot in the tubular header aligned with but generally opposite of the first mentioned slot. The baffle piece has a perimeter that is generally the same as the cross section of the tubular header with opposite sides having notches in the perimeter.

In a highly preferred embodiment, each notch has a parallel edge that is generally parallel to an edge of the other notch.

The invention contemplates that each notch further include a shoulder edge generally transverse to the parallel edge. In a highly preferred embodiment, the shoulder edges are aligned.

Generally, the tubular header will have a generally circular cross section and the baffle piece will have a circular perimeter of the same size as the cross section of the tubular header. Preferably, the notches are L-shaped.

Other objects and advantages will become apparent from the following specification taken in connection with the accompanying drawings.

DESCRIPTION OF THE DRAWINGS

FIG. 1 is a perspective view of a heat exchanger made according to the invention;

FIG. 2 is an enlarged, fragmentary plan view of a header used in forming the heat exchanger;

FIG. 3 is a side elevation of the header;

FIG. 4 is a sectional view taken approximately along the line 4—4 in FIG. 3;

FIG. 5 is a side elevation of a baffle;

FIG. 6 is a view similar to FIG. 4 but of a modified embodiment of the invention;

FIG. 7 is a view similar to FIG. 5 but of a modified embodiment of the invention that may be utilized with headers having the cross sections illustrated in FIGS. 4 or 6;

FIG. 8 is a view similar to FIGS. 4 and 6 but of a further modified embodiment of the invention;

FIG. 9 is a view similar to FIGS. 5 and 7 but illustrating a baffle intended for use with the embodiment of the invention illustrated in FIG. 8;

FIG. 10 is a view similar to FIGS. 4, 6 and 8 but of still a further modified embodiment of the invention; and FIGS. 11 and 12 illustrate two different embodiments of baffles that are intended for use with the embodiment of the invention illustrated in FIG. 10.

DESCRIPTION OF THE PREFERRED EMBODIMENTS

An exemplary embodiment of a heat exchanger made according to the invention is illustrated in the drawings and with reference to FIG. 1 is seen to include an upper header, generally designated 10, and a spaced, generally parallel, lower header, generally designated 12. As illustrated, both of the headers 10 and 12 are formed of elongated tubes of circular cross section. However, it is to be understood that the invention may find applicability where but a single one of the headers is formed of a tube.

Elongated, open ended oval or flattened tubes 14 in spaced, generally parallel relation extend between the headers 10 and 12 and are in fluid communication with the interior or each. Plate-like or serpentine fins (not shown) may be disposed between the headers 10 and 12 and in heat exchange relation with the tubes 14 in a conventional fashion as desired.

Suitable ports (not shown) are in fluid communication with the interior of each of the headers 10 and 12. The facing surfaces of the headers 10 and 12 are designated 18 and are the header surfaces. As seen in FIGS. 2 and 3, the header surfaces 18 include a series of spaced, generally parallel, elongated holes 20 which receive the ends 22 of the flattened tubes 14. The tubes 14 are bonded and sealed to the respective headers 10 and 12 within the holes 20 by any suitable means. Typically, the components will be formed of metal and the bond and seal will be formed by braze metal or solder.

Preferably, the header surfaces 18 between the holes 20 are formed as exteriorly convex domes 24 to provide improved resistance to pressure deformation as explained more fully in previously identified U.S. Pat. No. 4,615,385.

As illustrated in FIG. 1, the header 10 is provided with a baffle, generally designated 26 which serves to separate one end 28 from the other 30. As a consequence, a two-pass heat exchanger is defined. That is to say, fluid entering the end 28 will first travel downwardly through the left three of the tubes 14 to the header 12 and along the header 12 to the right two of the tubes 14 and then up to the end 30.

If three passes are desired, a similar baffle would be disposed in the lower header 12 at an appropriate location.

As seen in FIGS. 2 and 3, such a baffle might be disposed in the lower header 12 by means of upper and lower slots 32 and 34 respectively. The slots 32 and 34 are aligned with one another and located between the holes 20. In this embodiment of the invention, which is seen in section in FIG. 4, the slots 32 and 34 are formed by means of a saw.

The baffle 26 is inserted into the upper slot 34 and extends through the interior of the tube 12 and into the lower slot 32. More particularly, as seen in FIG. 5, the baffle 26 has a perimeter that is the same size and shape as the cross section of the tubular header 10 or 12. As illustrated, the same is circular about a center 36 and has a diameter equal to the outer diameter of the header 12.

The thickness of the baffle 26 is just ever so slightly less than the width of the slots 32 and 34 so as to allow the baffle 26 to be disposed therein in substantial contact with the sides thereof.

Opposite sides of the baffle 26 are provided with generally L-shaped notches 38 and 40. Each of the notches 38 and 40 has one edge 42 which is parallel to the corresponding edge 42 of the other notch. In addition, at approximately right angles to the parallel edges 42, each of the notches 38 and 40 has a shoulder edge 44 which extends from the edge 42 to the periphery of the baffle 26.

In use, the baffle 26 is introduced into the header through the appropriate one of the slots 32 or 34. In the configuration illustrated, it may be introduced into the header through the slot 34 and the shoulder edges 44 brought into abutment with the lower edges 46 of the slot 34. That part 48 of the lower periphery of the baffle 26 between the notches 38 and 40 will extend through the lower slot 32 and be in substantial alignment with the outer diameter of the tube 12. The opposite part 50 of the periphery will be in alignment with the outer diameter of the tube 12 in adjacency to the edges of the slot 34.

In some cases, the saw-cut slot 32 may be dispensed with in favor or a pierced slot 52 as shown in FIG. 6. In the case of this embodiment of the invention, the ends 53 of the slot 52 are parallel so as to abuttingly receive the parallel sides 42 of the notches 38 and 40.

FIG. 7 illustrates a baffle 26' similar to the baffle 26 that may be used with headers having the slot configurations illustrated in either FIGS. 4 and 6. The baffle 26' differs from the baffle 26 in that it has diametrically oppositely extending upper and lower tabs 54 and 55 respectively on the upper and lower parts 50 and 48 of the periphery.

When assembled in a header slot, the tabs 54 and 55 will project beyond the periphery thereof and may be bent over or twisted to lock the baffle 26' in place. In this connection, in many instances, only the bottom tab 55 is required because of the presence of the shoulders 44, meaning that the upper tab 54 may be omitted if desired. However, in some instances it can be utilized to locate a mounting bracket or, if enlarged from the shape shown in FIG. 7, could even serve as part of the mounting bracket itself.

In still other instances, where greater strength is desired, the lower slot may be formed in two sections 56 and 58 as illustrated in FIG. 8 as by piercing with an intermediate web 60 between the sections 56 and 58. The edges 62 and 64 of the sections 56 and 58 are again parallel.

In this case, the baffle 26" shown in FIG. 8 may be used. The baffle 26" is otherwise identical to the baffle 26 save for the fact that the part 48 of the periphery is provided with an additional notch 70 that conforms basically the shape of the web 60 separating the slot sections 56 and 58.

FIG. 10 illustrates still a further embodiment of a header tube 12 made according to the invention. In the case of the embodiment of FIG. 10, the slot 34 is as before but the lower slot 32 or 52 is dispensed with in favor of a slot 80 having sides 82 which convert towards each other from top to bottom. When this embodiment of the invention is utilized, shoulders such as the shoulders 44 on the baffles may be dispensed with. Rather, a circular baffle 26''' such as shown in FIG. 11 may be used. The baffle 26''' is strictly circular save for opposed notches defined by two straight, converging edges 84 which converge from top to bottom at the same angle as the edges 82 of the slot 80 and which are disposed so as to be in abutment with the edges 82 when the periphery of the baffle 26''' is congruent with the periphery of the tube 12.

In some instances, a trapezoidal baffle such as the baffle 26'''' may be employed. The baffle 26'''' has edges 86 that converge from top to bottom at the same angle as the edges 84 of the baffle 26''' and which orientate themselves with respect to the edges 82 in the identical fashion. The only difference between the baffle 26''' and the baffle 26'''' is that the latter is not intended to fit within the peripheral envelope of the tube 12 whereas the former is.

The baffle made according to the invention possesses a number of advantages over those heretofore known. For one, the braze potential is enhanced because there is an increase in the surface area of the baffles that is in contact or close adjacency to parts of the header 10 or 12 over prior construction such as that disclosed in the previously identified Japanese patent publication. This greater amount of area available for brazing increases the likelihood that a satisfactory bond and seal by brazing will be achieved.

Because each header 10, 12 has two slots, as opposed to one in the construction of the Japanese patent publication, leakage across the baffle is more easily detected as it will appear as external leakage through the slots.

It will also be readily appreciated that the slots as well as the assembly of the baffles to the construction can occur before or after core assembly, thereby providing additional flexibility in the manufacturing process.

In addition, the greater use of slots provides a further advantage in terms of venting vapors or gases from the core during the brazing process.

I claim:

1. In a heat exchanger having a pair of elongated spaced headers and tubes extending between the headers and in fluid communication with the interior thereof, at least one of the headers being tubular and having a slot on one side generally transverse to the length of the tubular header and a baffle piece disposed in the slot to prevent full flow of a heat exchange fluid through the tubular header at the location of the baffle, the improvement comprising:

an additional slot in said tubular header aligned with but generally opposite of said slot;

said baffle piece having a perimeter generally the same as the cross section of the tubular header with opposite sides having notches in said perimeter, each said notch having a parallel edge that is generally parallel to an edge of the other notch.

2. The heat exchanger of claim 1 wherein each notch includes a shoulder edge generally transverse to the parallel edge.

3. The heat exchanger of claim 2 wherein said shoulder edges are aligned.

4. The heat exchanger of claim 1 wherein each notch includes a shoulder edge extending from the corresponding parallel edge to said perimeter.

5. The heat exchanger of claim 1 wherein said perimeter, at a location between said notches, has at least one outwardly extending tab.

6. The heat exchanger of claim 5 wherein each said notch includes a shoulder edge extending from the corresponding parallel edge to said perimeter and said tab is located oppositely of said shoulder edges.

7. In a heat exchanger having a pair of elongated spaced headers and tubes extending between the headers and in fluid communication with the interiors thereof, at least one of the headers being tubular with a generally circular cross section and having a slot on one side generally transverse to the length of the tubular header and a baffle piece disposed in the slot to prevent full flow of a heat exchange fluid through the tubular header at the location of the baffle, the improvement comprising:

an additional slot in said tubular header aligned with but generally opposite of said slot;

said baffle piece having a circular perimeter of the same size as the tubular header and with opposite sides having generally L-shaped notches in said perimeter, each said notch having a parallel edge that is generally parallel to an edge of the other notch.

8. The heat exchanger of claim 7 wherein said additional slot has two sections and further including an additional notch in said periphery at a location between said parallel edges.

9. In a heat exchanger having a pair of elongated spaced headers and tubes extending between the headers and in fluid communication with the interiors thereof, at least one of the headers being tubular with a circular cross section and having a slot on one side generally transverse to the length of the tubular header and a baffle piece disposed in the slot to prevent full flow of a heat exchange fluid through the tubular header at the location of the baffle, the improvement comprising:

an additional slot in said tubular header aligned with but generally opposite of said slot;

said baffle piece having a circular perimeter generally the same size as the circular cross section of the tubular header with opposite sides having notches in said perimeter.

10. In a heat exchanger having a pair of elongated spaced headers and tubes extending between the headers and in fluid communication with the interiors thereof, at least one of the headers being tubular with a generally circular cross section and having a slot on one side generally transverse to the length of the tubular header and a baffle piece disposed in the slot to prevent full flow of a heat exchange fluid through the tubular header at the location of the baffle, the improvement comprising;

an additional slot in said tubular header aligned with, but generally opposite, of said slot and having spaced edges;

said baffle piece extending through both of said slots and having opposed edges in substantial abutment with the opposed edges of said additional slot.

11. The heat exchanger of claim 10 wherein said edges are parallel.

12. The heat exchanger of claim 10 wherein said edges are converging edges.

13. The heat exchanger of claim 12 wherein said baffle has a generally circular perimeter.

14. The heat exchanger of claim 12 wherein said baffle has a trapezoidal perimeter.

* * * * *